US007603791B1

(12) United States Patent
Griffin

(10) Patent No.: US 7,603,791 B1
(45) Date of Patent: Oct. 20, 2009

(54) CONDITIONING APPARATUS

(76) Inventor: John Griffin, 5980 Love Ct., Hope Mills, NC (US) 28348

( * ) Notice: Subject to any disclaimer, the term of this patent is extended or adjusted under 35 U.S.C. 154(b) by 1180 days.

(21) Appl. No.: 10/390,074

(22) Filed: Mar. 17, 2003

Related U.S. Application Data

(62) Division of application No. 09/954,227, filed on Sep. 17, 2001, now Pat. No. 6,557,266.

(51) Int. Cl.
*F26B 21/096* (2006.01)
*F26B 21/06* (2006.01)

(52) U.S. Cl. ..... 34/77

(58) Field of Classification Search ..... 34/286, 34/294, 299, 300, 330, 341, 446, 472, 473, 34/480, 507, 578, 587, 71, 69, 81, 82, 95, 34/165, 168, 449, 468, 474, 477, 514, 73, 34/77, 604, 134; 165/4, 8, 96, 907; 62/476, 62/487; 95/52; 210/500.21
See application file for complete search history.

(56) References Cited

U.S. PATENT DOCUMENTS 4,098,852 A * 7/1978 Christen et al. ..... 261/104
4,270,282 A * 6/1981 Lotz ..... 34/86
4,360,977 A * 11/1982 Frohbieter ..... 34/86
4,603,489 A * 8/1986 Goldberg ..... 34/77
4,793,072 A * 12/1988 Igarashi et al. ..... 34/9
4,819,342 A * 4/1989 Matsubara et al. ..... 34/95
4,856,204 A * 8/1989 Hindstrom ..... 34/95
4,870,760 A * 10/1989 Graff ..... 34/32
5,236,474 A * 8/1993 Schofield et al. ..... 95/47
5,528,905 A * 6/1996 Scarlatti ..... 62/3.4
5,546,673 A * 8/1996 Weagraff et al. ..... 34/80
5,771,707 A * 6/1998 Lagace et al. ..... 62/271

* cited by examiner

*Primary Examiner*—Kenneth B Rinehart
(74) *Attorney, Agent, or Firm*—Coats & Bennett, P.L.L.C.

(57) ABSTRACT

A conditioning apparatus for conditioning a treated fluid includes a conditioning chamber for containing a flow of a treated fluid and an exchange element disposed within said conditioning chamber having one or more fluid passages formed therein filled with a saline solution. The exchange element has a semi-permeable membrane that allows fluid transfer between said treated fluid and said saline solution through said semi-permeable membrane.

17 Claims, 12 Drawing Sheets

CONDITIONING APPARATUS

The present application is a divisional application of U.S. patent application Ser. No. 09/954,227 filed Sep. 17, 2001 now U.S. Pat. No. 6,557,266.

BACKGROUND OF THE INVENTION

The present invention relates devices for conditioning fluids, and, more particularly, to a device for changing the temperature or water content of a fluid.

In a conventional air-conditioning system, an air flow into a conditioned space flows through an air handler having heat exchange elements disposed therein. A cooled refrigerant or other liquid flowing through the heat exchange element transfers heat from the air flow into the conditioned space. One problem associated with conventional air handlers is the formation of condensation. When the air flow contacts the cool surfaces of the heat exchange elements, condensation and/or ice forms on the heat exchange element. Therefore, conventional air handler typically include a drip pan to collect the condensation.

It is often desirable to humidify or dehumidify an air flow in addition to heating and/or cooling the air. Conventional air-conditioning systems have only an incidental affect on the moisture content of the air. When the air is cooled, it holds less moisture, and when air is warm, it holds more moisture. This indirect affect does not provide sufficient control over the moisture content in a conditioned space. Therefore, conventional air conditioning systems provide a separate humidifier and dehumidifier to add moisture to or remove moisture from the air flow when such is required, thereby increasing the cost and complexity of the air-conditioning system.

BRIEF SUMMARY OF THE INVENTION

The present invention relates to an apparatus for conditioning air, liquids, or other fluids. The conditioning apparatus comprises an exchange element having a semi-permeable membrane. A conditioning fluid, such as a saline solution flows through the exchange element. Water is transferred across the semi-permeable membrane between the conditioning fluid and the conditioned product. Heat transfer between the conditioned product and the conditioning fluid may also occur.

One beneficial use of the present invention is for conditioning an air flow. There are many applications in which it is desirable to heat or cool an air flow or to humidify or dehumidify an air flow. For example, the present invention may be used in an air-conditioning system to condition air in a space occupied by people or refrigerated space for products. The present invention may be used as part of a drying apparatus, such as a hair dryer and clothes dryer, to condition the air flow into the drying apparatus.

Another useful application for the present invention is in drying grains (e.g., corn, wheat, rice, etc.) and pulses (e.g., beans and peas). The present invention may be employed in a storage bin that contains the product being dried. Alternatively, the present invention may be used to condition an air flow into a drying chamber where the product being dried is contained.

DETAILED DESCRIPTION OF THE INVENTION

Figure 1:
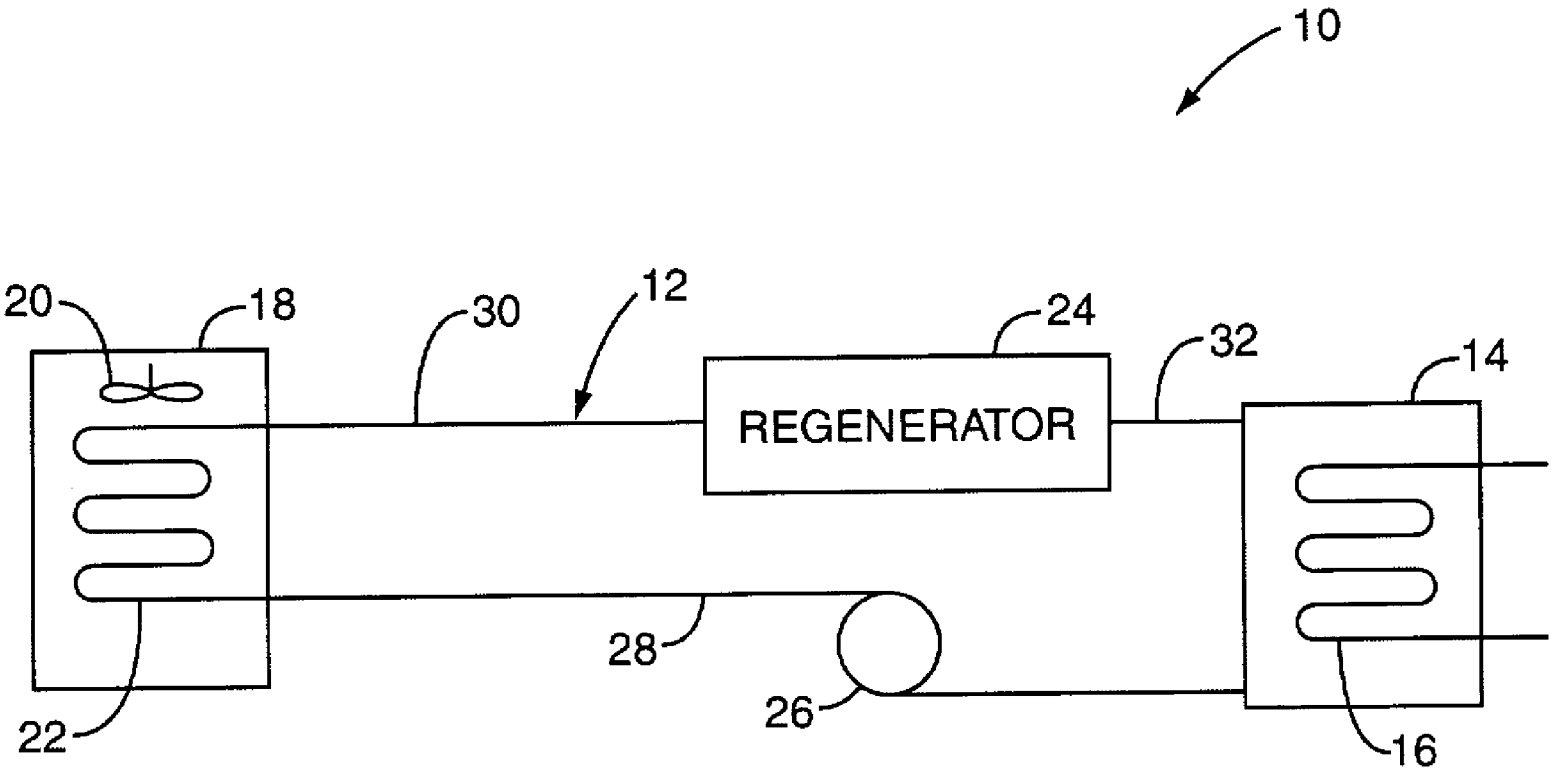
FIG. 1 is a schematic diagram of the conditioning apparatus of the present invention.

Referring now to the drawings and, particularly, to FIG. 1, the conditioning apparatus is shown therein and indicated generally by the numeral 10. For the sake of brevity, the heat and mass conditioning apparatus is referred to herein simply as the conditioning apparatus 10. The energy and mass conditioning apparatus 10 may be used to transfer heat and mass to or from a conditioned space. The conditioning apparatus 10 has a variety of applications, including comfort heating and cooling, refrigeration, product drying and curing, water reclamation from liquids and gases, and heat reclamation.

FIG. 1 is a schematic diagram of the conditioning apparatus 10 of the present invention. As shown in FIG. 1, the conditioning apparatus 10 comprises a closed circuit 12 through which a conditioning fluid circulates. The conditioning fluid may for example comprise a saline solution. The closed circuit 12 includes a thermal conditioner 14 for heating or cooling the brine solution, an exchanger 18 for transferring heat and/or water to or from a conditioned product, a regenerator 24 for restoring the concentration of the spent brine solution, and a pump 26 for circulating the brine solution. The brine solution enters the exchanger 18 along line 28, passes through exchange element 22 and exits the heat exchanger 18 along line 30. The exchange element 22 may, for example, comprise a coil or radiator for heating or cooling a surrounding air mass or fluid. As will be described in greater detail below, the walls of the exchange element 22 include a semi-permeable membrane. Fluid passes through the semi-permeable membrane by diffusion, as will be described below. The exchanger 18 may optionally include a fan 20 to circulate air or fluid through the exchanger 18. In a cooling mode, the brine solution transfers heat from the surrounding air mass or fluid. Water contained in the surrounding air mass or fluid also diffuses through the membrane of the exchange element 22 into the brine solution. In a heating mode, the brine solution gives up or rejects heat into the surrounding air mass or fluid and water passes by diffusion from the brine solution into the surrounding air mass or fluid. The spent brine solution exists the exchanger 18 along line 28 and enters the regenerator 24.

Regenerator 24 restores the salt concentration of the brine solution exiting the exchanger 18. When operated in a cooling mode, the spent brine solution exiting the exchanger 18 is diluted by the moisture absorbed from the conditioned product. In this case, the regenerator 24 removes water from the brine solution to restore the brine solution. In the heating mode, the brine solution loses water to the conditioned product so the spent brine solution has a higher than normal salt concentration. In this case, regenerator 24 dilutes the brine solution to restore the brine solution.

The regenerated brine solution exits the regenerator 24 along line 32 and enters the thermal conditioner 14. The thermal conditioner 14 heats or cools the brine solution, depending upon the operating mode, to produce the conditioned brine solution. The thermal conditioner 14 functions as a brine solution chiller when the conditioning apparatus 10 is operated in a cooling or drying mode. The thermal conditioner 14 in this case may use an evaporator, cooling tower, ground water, ambient air, ice, or any other process stream having less heat content than the heat content of the brine solution. The thermal conditioner 14 functions as a heater/boiler when the conditioning apparatus 10 is operated in a heating or humidifying mode. Thermal conditioner 14 in this case may comprise a condenser, solar panel, fuel-fired boiler, or other heat source. The brine solution is cooled or heated by the thermal conditioner 14 and exists along line 28 to complete the circuit.

Figure 2:
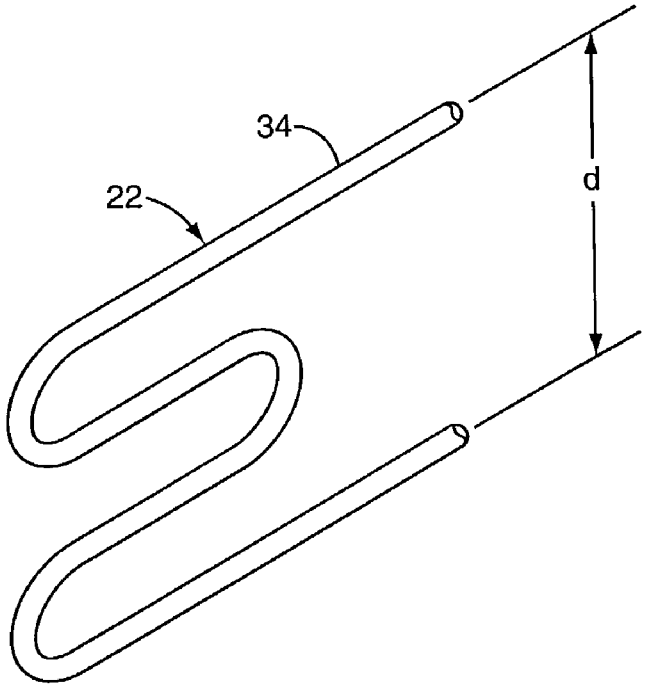
FIG. 2 is a perspective view of a exchange element used in the conditioning apparatus.
Figure 3:
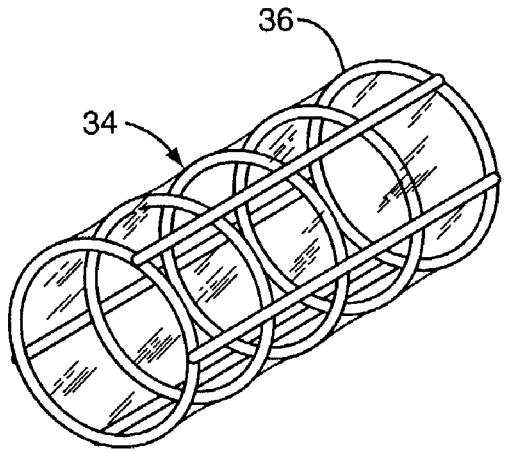
FIG. 3 is a perspective view showing a segment of the exchange element in more detail.

FIGS. 2 and 3 illustrate the exchange element 22 in more detail. As shown in FIG. 2, the exchange element 22 may comprise a tube 34 that winds back and forth as shown in FIG. 2. Tube 34 may also form a coil or other shape. The exchange element 22, however, is not necessarily tubular in form. The exchange element 22 could be made similar to baffling plates or corrugated plates instead of tubes. The tube 34, as previously stated, includes or comprises a semi-permeable membrane 36 through which fluid diffuses under osmotic pressure. The semi-permeable membrane 36 may, for example, comprise polyvinylidene chloride (PVDC), which is more commonly referred to as Saran®. PVDC is formed by polymerizing vinylide chloride with monomers such as acrylic esters and unsaturated carboxyl groups, forming long chains of vinylide chloride. The copolymerization results in a film with molecules bound so tightly together that very little gas or water can pass through the film. The result produces a barrier against oxygen, moisture, and chemicals.

In the present invention, water is transferred across the semi-permeable membrane 36 by osmosis. The semi-permeable membrane 36 acts as a selective barrier, allowing water but not salt to flow through the membrane 36. A strong brine solution is used when transferring water from a surrounding air mass or fluid into the brine solution. To transfer water from the brine solution into the surrounding air mass or fluid, a weak brine solution is used.

The exchange element 22 according to the present invention has several advantages over conventional heat exchange elements. Convention heat exchange elements have an air velocity limitation of less than 700 feet per minute to prevent condensate from blowing off the heat exchange element. The exchange element 22 of the present invention does not have this limitation. Also, heat exchange elements are usually operated at a temperature above 32° F. when possible to avoid defrost requirements. The exchange element 22 of the present invention may be operated at a much lower temperature and the volume of air may be reduced.

The conditioning apparatus 10 of the present invention has a wide variety of applications. FIGS. 4 through 12 illustrate some exemplary applications of the conditioning apparatus.

Figure 4:
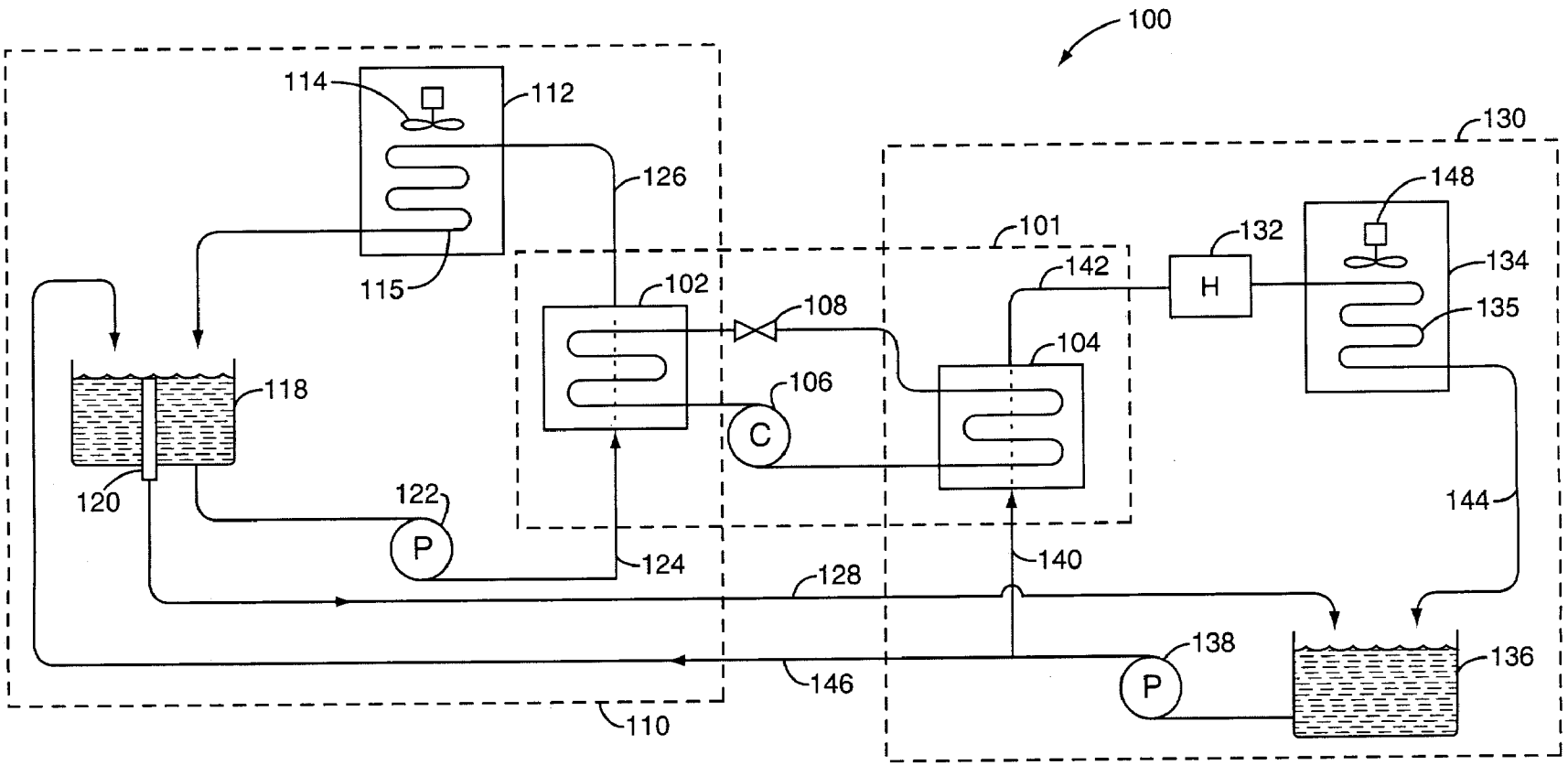
FIG. 4 is a schematic diagram of an air conditioning system using the conditioning apparatus of the present invention.

FIG. 4 illustrates an air conditioning system indicated generally by the numeral 100 using the present invention. The air conditioning system 100 comprises a refrigeration system 101, a cooling system 110, and a heating system 130. The refrigeration system 101 cools the brine solution used by the cooling system 110 and heats the brine solution used by the heating system 130. Cooling system 110 transfers heat and water from a conditioned space into the brine solution. Conversely, heating system 130 transfers heat and water from a brine solution into the conditioned space.

Refrigeration system 101 operates in a conventional manner. Refrigerant passes through the evaporator 102 where it transfers heat from the brine solution and vaporizes, becoming slightly super heated. Compressor 106 compresses the vaporized refrigerant, exiting the evaporator 102, which further increases the temperature of the refrigerant. The high temperature, high-pressure refrigerant passes through the condenser 104 where it loses energy to the brine solution and condenses. Liquid refrigerant exiting the condenser 104 passes through the expansion valve 108, which further reduces the pressure and cools the liquid refrigerant.

The refrigeration system 101 described above employs a vapor compression cycle. Those skilled in the art will recognize that refrigeration system 100 could, alternatively, use an absorption cycle.

Cooling system 110 includes the evaporator 102, a heat exchanger 112, fan 114, recovery tank 118, and pump 122. Brine solution enters the evaporator 102 where it is cooled. The cooled brine solution exiting the evaporator 102 passes through heat exchanger 112 has a temperature of between 10° F. and 55° F. and a salt concentration of approximately 20%. The conditioned brine solution enters the heat exchanger 112 where it transfers heat and absorbs water from the air flow into the conditioned space. Heat exchanger 112 includes an exchange element 115 as shown in FIGS. 2 and 3 that allows water from the surrounding air flow to be absorbed by the brine solution. Heat exchanger 112 may use natural convection, or may employ a fan 114 to circulate air over the exchange element 115. Spent brine solution exits the heat exchanger 112. The brine solution is diluted by the absorption of water from the surrounding air flow so that the concentration of the brine solution exiting the heat exchanger 112 is approximately 15%. The brine solution passes through an auxiliary heater 116 and empties into recovery tank 118. In recovery tank 118, the spent brine solution is regenerated by mixing it with concentrated brine solution entering the recovery tank 118 through return line 146. As will be described in greater detail below, return line 146 transfers concentrated brine solution from recovery tank 136 in the heating system 130 to the recovery tank 118. The brine solution in the recovery tank 118 overflows into stand pipe 120 and passes through line 128 into recovery tank 136. The brine solution in recovery tank 118 is drawn out by pump 122 which circulates the brine solution through the cooling system 110.

The heating system 130 comprises the condenser 104, auxiliary heater 132, heat exchanger 134, recovery tank 136, and pump 138. Brine solution enters condenser 104 through line 140 where it is heated to a temperature of approximately 130° F. to 180° F. The salt concentration of the brine solution exiting the condenser 104 is approximately 20%. The brine passes along line 142 through auxiliary heater 132. In an air conditioning system 100, the heat generated by condenser 104 may not be sufficient to heat the brine solution sufficiently for operation. Therefore, auxiliary heater 132 may be needed to further heat the brine solution to a required temperature. The heated brine solution enters heat exchanger 134 and passes through exchange element 135. The exchange elements 135 include a semi-permeable membrane as shown in FIGS. 2 and 3 that allows water from the brine solution to escape into the surrounding air flow. Air may be circulated through heat exchanger 134 by natural convection. Alternatively, a fan 148 may circulate air through the heat exchanger 134. Because the brine solution loses water to the environment in heat exchanger 134, the brine solution exiting heat exchanger 134 is a concentrated brine solution with a salt concentration of approximately 23%. The concentrated brine solution exiting heat exchanger 134 passes through line 144 and enters into recovery tank 136 where it is mixed with diluted brine solution 128 entering recovery tank 136 along line 128. A portion of the brine solution from recovery tank 136 returns through line 146 into recovery tank 118 as previously described. Thus, there is a continuous exchange of brine solution between the cooling system 110 and heating system 130.

Figure 5:
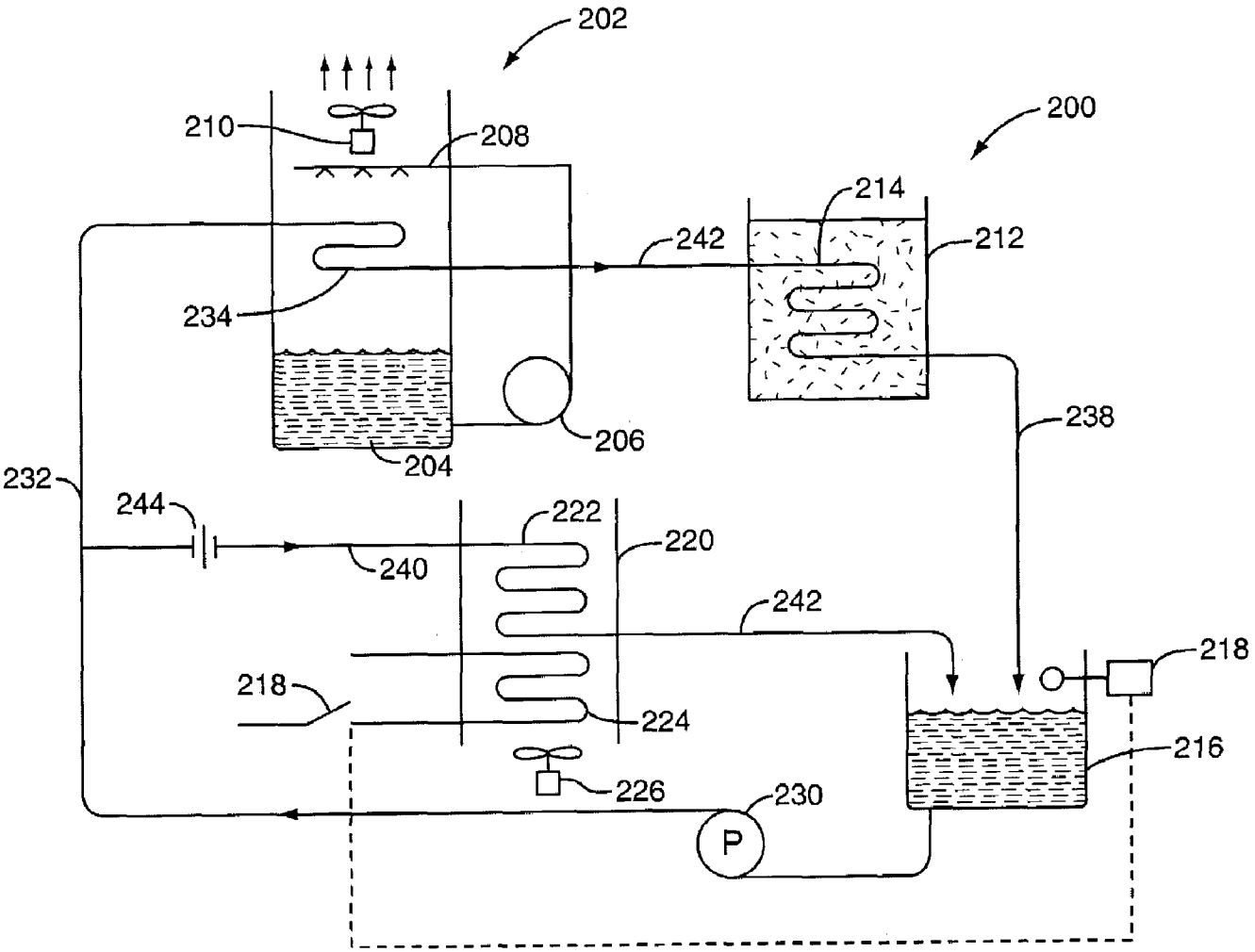
FIG. 5 is a schematic diagram of a product dryer using the conditioning apparatus of the present invention.

Another application of the conditioning apparatus 10 is bulk product drying. The bulk product may be a solid (e.g., fruit, corn, or grain), a liquid (e.g., alcohol, gasoline, etc.), or a gas (e.g., compressed air). FIG. 5 illustrates a bulk product dryer, indicated generally by the numeral 200, which incorporates the conditioning apparatus 10 of the present invention.

Bulk product dryer 200 comprises an evaporative cooler 202, drying bin 212, recovery tank 216, concentrator 220, and pump 230. A brine solution with a salt concentration of approximately 30% enters the evaporative cooler 202 through line 232. The brine solution passes through a coil 234 in the evaporative cooler 202 where the brine solution is cooled to a temperature of approximately 80° F. Evaporative cooler 202 includes a sump 204, pump 206, spray bar 208, and cooling fan 210. Pump 206 feeds water from the sump 204 to the spray bar 208, which sprays water over the cooling coil 234. Fan 210 produces an air flow over the cooling coil 234 which cools the brine by evaporative cooling.

The cooled brine solution exits the evaporative cooler 202 along line 236 and enters the drying bin 212. Drying bin 212 comprises a bin for storing product to be dried. In the drying bin 212, the cooled brine solution passes through a exchange element 214 constructed as shown in FIGS. 2 and 3. Water contained in the product being dried passes by osmosis through the wall of the exchange element 214 into the brine solution. Thus, the brine solution functions as an absorbent to absorb water from the product being dried.

The brine solution is diluted by water absorbed from the product. The brine solution exiting the drying bin 212 has a concentration of approximately 20%. The diluted brine solution exiting drying bin 212 flows along line 238 and enters recovery tank 216 where the diluted brine solution is mixed with a concentrated brine solution entering the recovery tank 216 along line 242. Pump 230 draws the regenerated brine solution from the recovery tank 216, which flows through line 232 into the evaporative cooler 202. A portion of the brine solution is diverted along line 240 to a concentrator 220. Concentrator 220 removes some of the water from the brine solution to produce a highly concentrated brine solution. The concentrated brine solution exits the concentrator 220 along line 242 and enters into the recovery tank 216 where it mixes with the diluted brine solution. Thus, recovery tank 216 and concentrator 220 selectively function as a regenerator to restore the concentration of the brine solution circulating through the drying bin 212.

The concentrator 220 includes a membrane regeneration coil 222, a heating coil 224, and a fan 226. The membrane regeneration coil 222 is constructed as shown in FIGS. 2 and 3 and includes a semi-permeable membrane 36. The heating element 224 heats air that is circulated by fan 226. The air picks up heat as it passes over the heating elements 224. As the heated air passes over the membrane regeneration coil 222, water from the strong brine solution is transferred across the semi-permeable membrane 36 into the hot air flow. This loss of water produces a more concentrated brine solution. The amount of water flowing through the concentrator 220 is controlled by an orifice 244 disposed along line 240.

Figure 6:
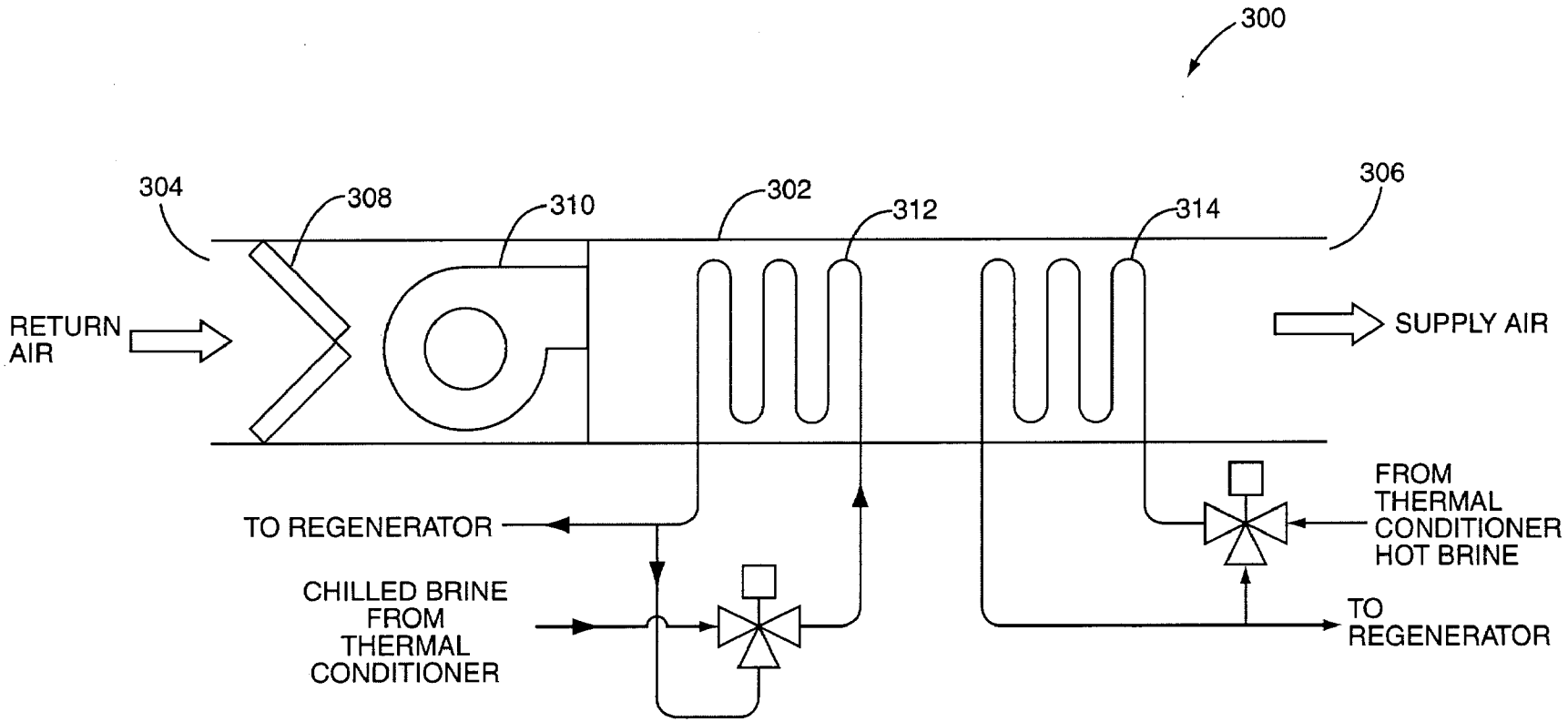
FIG. 6 is a schematic diagram of a fan coil unit using the conditioning apparatus of the present invention.

FIG. 6 illustrates an air handling unit, indicated generally by the numeral 300, which uses the conditioning apparatus of the present invention. Air handling unit 300 comprises an air duct 302 having an inlet 304 and outlet 306. One or more filters 308 are disposed at the inlet of the air duct 302. A blower 310 pulls air through the filters 308 and expels air through outlet 306. As the air travels through duct 302, the air passes over exchange elements 312, 314. The exchange elements 312, 314 are constructed as shown in FIGS. 2 and 3. A chilled brine solution circulates through exchange element 312 and a hot brine solution circulates through exchange element 314. Exchange element 312 may be used to cool and/or dehumidify the supply air. Conversely, exchange element 314 may be used to heat and/or humidify the supply air. The thermal conditioner and regenerator for the exchange elements 312, 314 are not shown in FIG. 6, but would be present and operate as previously described.

Figure 7:
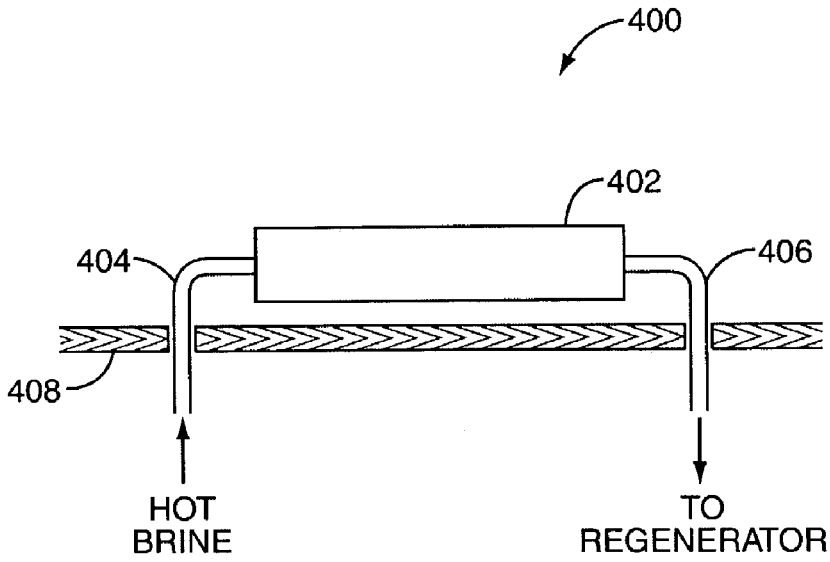
FIG. 7 is a schematic diagram of a radiant heater using the conditioning apparatus of the present invention.

FIG. 7 shows the present invention configured as radiant heater 400. The radiant heater 400 comprises an exchange element 402 in the form of a tube as shown in FIG. 3. Hot brine enters the exchange element 402 through inlet pipe 404 and exits through outlet pipe 406. Inlet pipe 404 connects in series to a preceding heater or to a thermal conditioner that heats the brine solution. Outlet pipe 406 connects to a subsequent heater 400 or to a regenerator 24. The radiant heater 400 may, for example, comprise a baseboard heater disposed adjacent a floor 408. The radiant heater 400 could also comprise a radiator coil that could be concealed in a cabinet.

Figure 8:
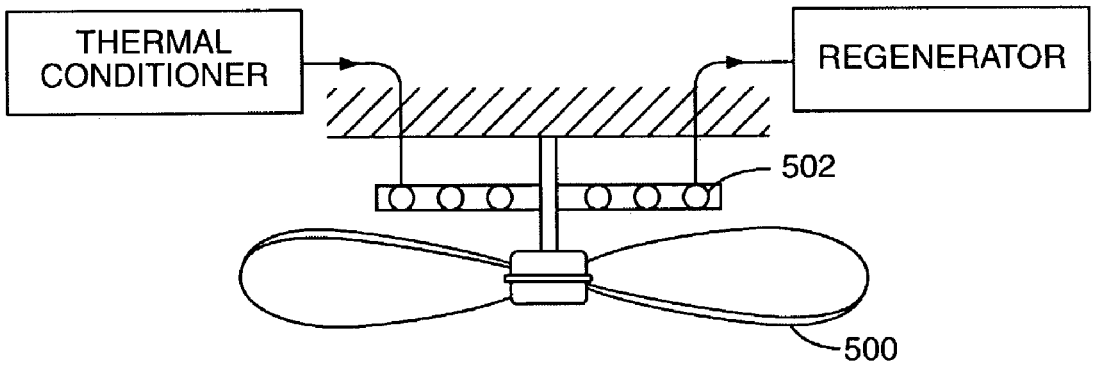
FIG. 8 is a schematic diagram of a ceiling fan using the conditioning apparatus of the present invention.

FIG. 8 shows the conditioning apparatus 10 of the present invention adapted for use in a ceiling fan 500. The ceiling fan 500 includes an exchange element 502, which may be in the form of a grid. A heated or chilled brine solution is circulated through the grid 502 to achieve the desired effect. For example, a hot brine solution may be circulated through grid 502 to heat and/or humidify the air, while a chilled brine solution can be circulated through the grid 502 to cool and/or dehumidify the air.

Figure 9:
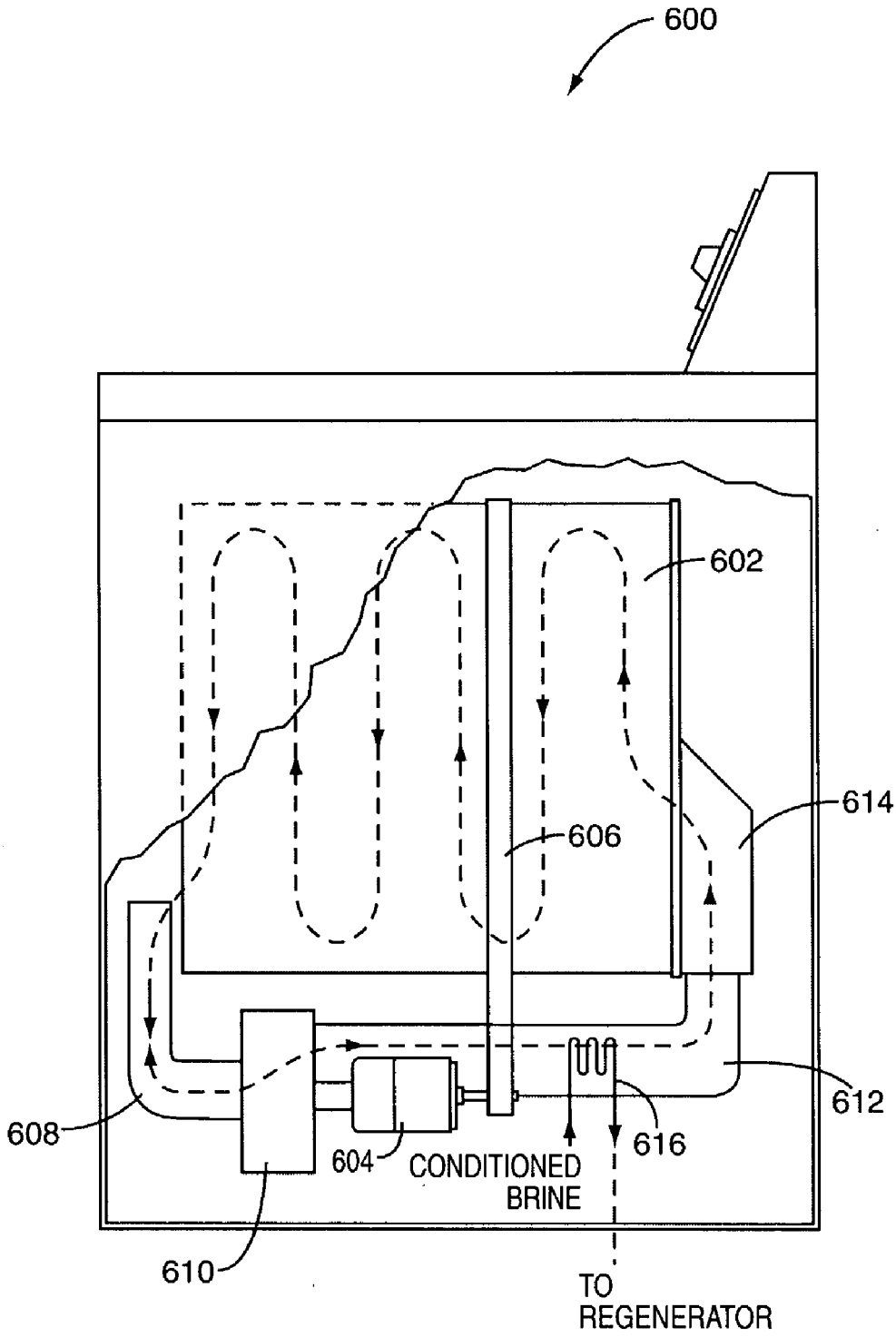
FIG. 9 is a schematic diagram of a clothes dryer using the conditioning apparatus of the present invention.

FIG. 9 illustrates a clothes dryer indicated generally by the numeral 600 using the conditioning apparatus 10 of the present invention. The clothes dryer 600 includes a rotating drum 602 driven by a motor 604 and drive belt 606. Conditioned air enters the rear of the drum 602 and exits at the front of the drum 602. The conditioned air picks up moisture from the damp clothing inside the drum 602. The damp air exiting the drum 602 enters a manifold 608, which connects to a blower 610. The purpose of the blower 610 is to circulate the air through the drum 602. The air from the blower 610 passes through a manifold 612. Located in manifold 612 is an exchange element 616 constructed as shown in FIGS. 2 and 3. As the damp air passes over the exchange element 616, moisture in the damp air is transferred across the semi-permeable membrane into the brine solution circulating within the exchange element 616. The dryer 600 may optionally include a heating chamber 614 where the conditioned air is heated before it is returned to the drum 602. The air may be heated by any conventional means, such as an electric resistance heater or gas heater. One advantage of the clothes dryer 600 of the present invention is that damp air exiting the drum 602 is recirculated rather than vented. Thus, the clothes dryer 600 of the present invention does not require a vent. The clothes dryer 600 will also work without a heater, thereby saving energy and reducing cost of operation.

Figure 10:
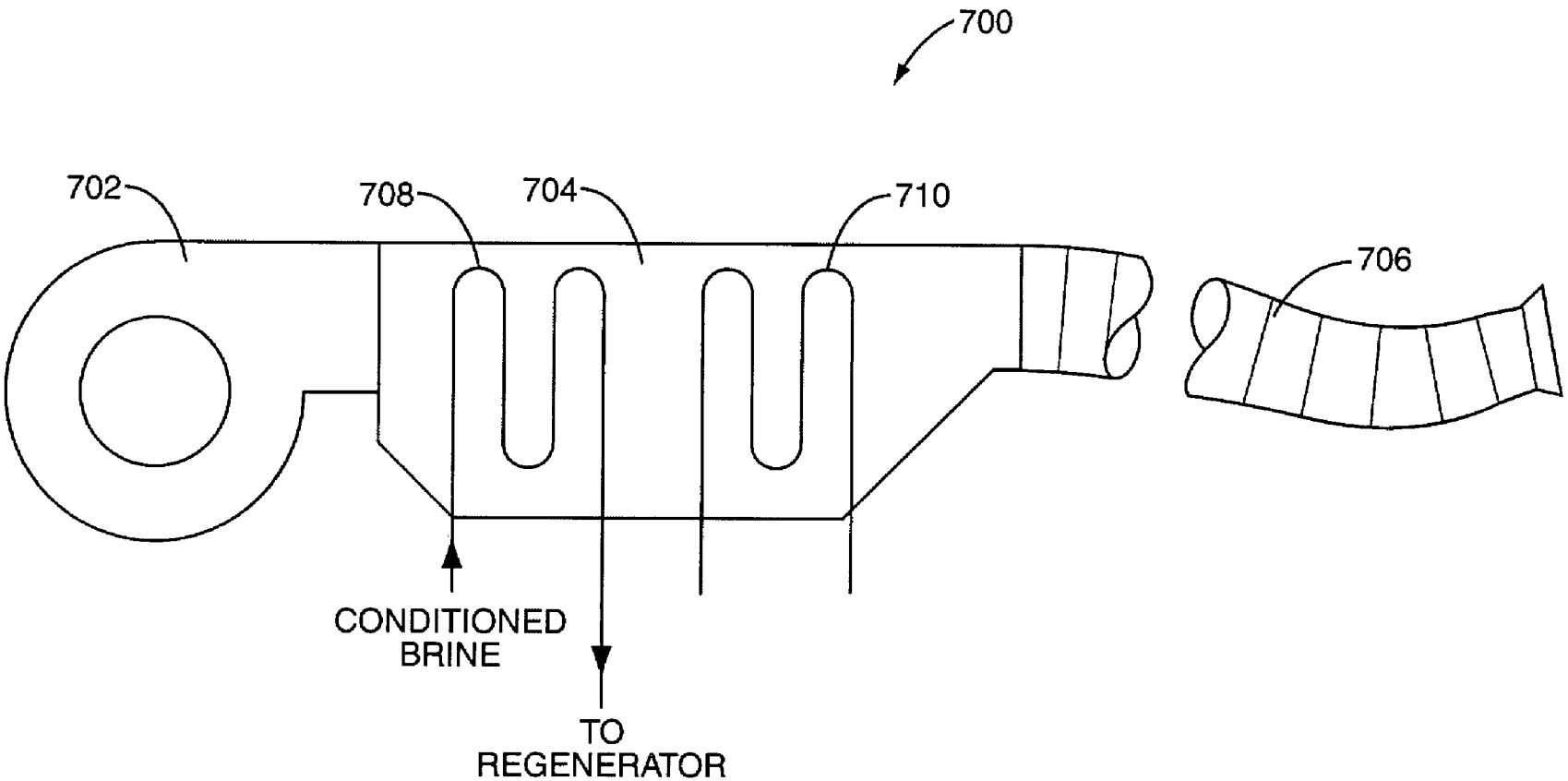
FIG. 10 is a schematic diagram of a hair dryer using the conditioning apparatus of the present invention.

FIG. 10 illustrates the conditioning apparatus 10 of the present invention used in a hair dryer, indicated generally by the numeral 700. The hair dryer 700 includes a blower 702, manifold 704, and flexible outlet hose 706. Within manifold 704, there is an exchange element 708 constructed as shown in FIGS. 2 and 3. Manifold 704 may further include a heating element 710, which may for example comprise an electric resistance heater. Blower 704 circulates air over the exchange element 708. As the air passes over the exchange element 708, moisture contained in the air is transferred into the strong brine solution circulating within the exchange element 708. The air may then be heated as it passes over the heating element 710. The heated and dried air exits through a flexible hose 706, which is used to direct the heated and dried air onto the user's air.

Figure 11:
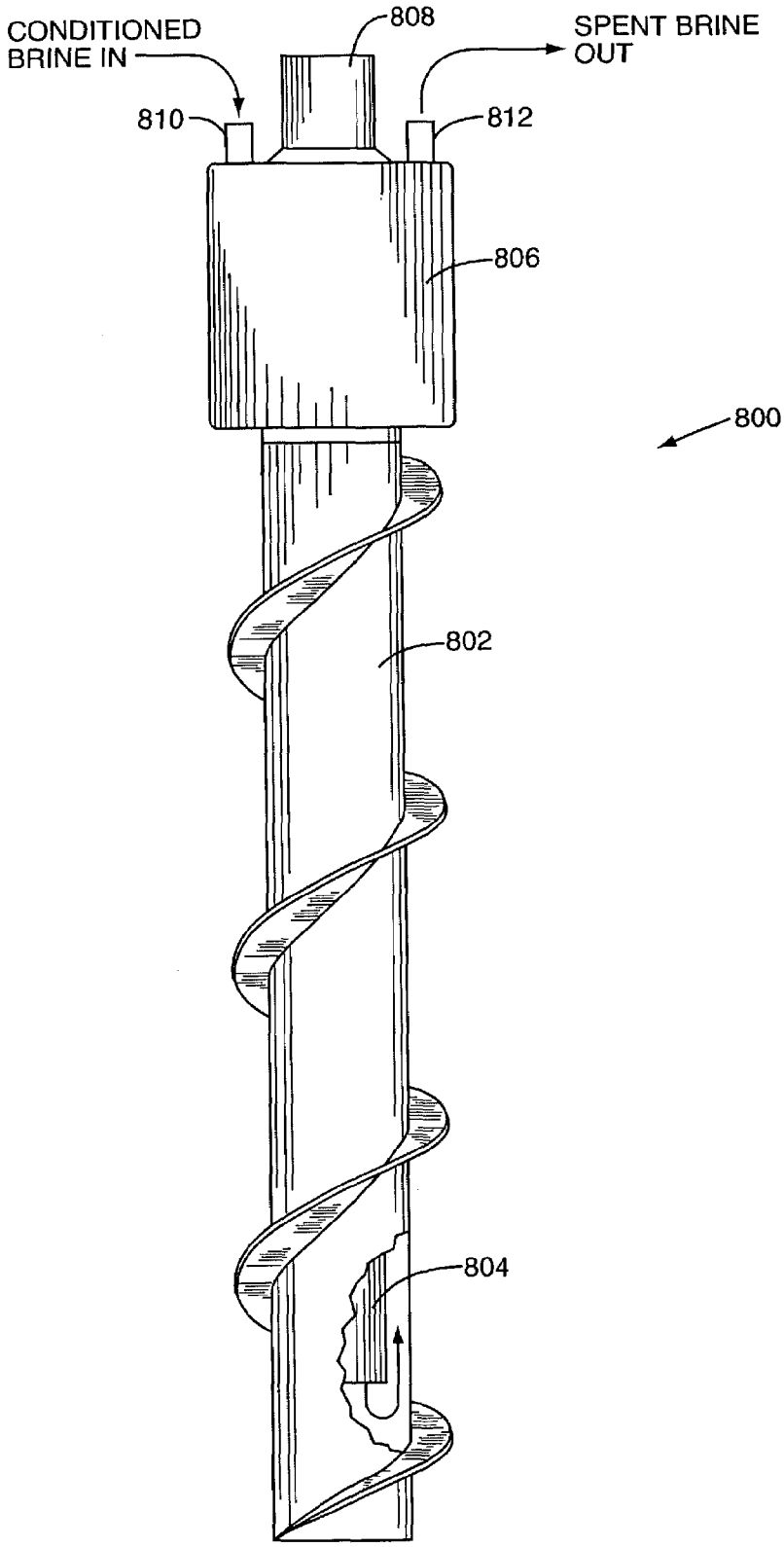
FIG. 11 is a schematic diagram of an auger-type dryer using the conditioning apparatus of the present invention.

FIG. 11 illustrates and auger-type dryer, indicated generally by the numeral 800, incorporating the conditioning apparatus 10 of the present invention. The auger-type dryer 800 comprises an auger tube 802, a supply tube 804, a rotary unit 806, and an electric motor 808. Auger tube 802 connects to the rotary unit 806 and is driven by motor 808. The auger tube 802 has a semi-permeable membrane. Conditioned brine enters the rotary unit 806 through inlet 810, which connects to the supply tube 804. The conditioned brine exits the bottom end of the supply tube 804 and flows upward through the auger tube 802 before it exits through outlet 812. In use, the auger tube 802 is pushed into a product to be dried, such as corn. When the product comes into contact with the auger tube 802, moisture contained in the product is absorbed through the semi-permeable membrane into the brine solution. The diluted brine solution exits through outlet 812 in the rotary unit 806.

Figure 12:
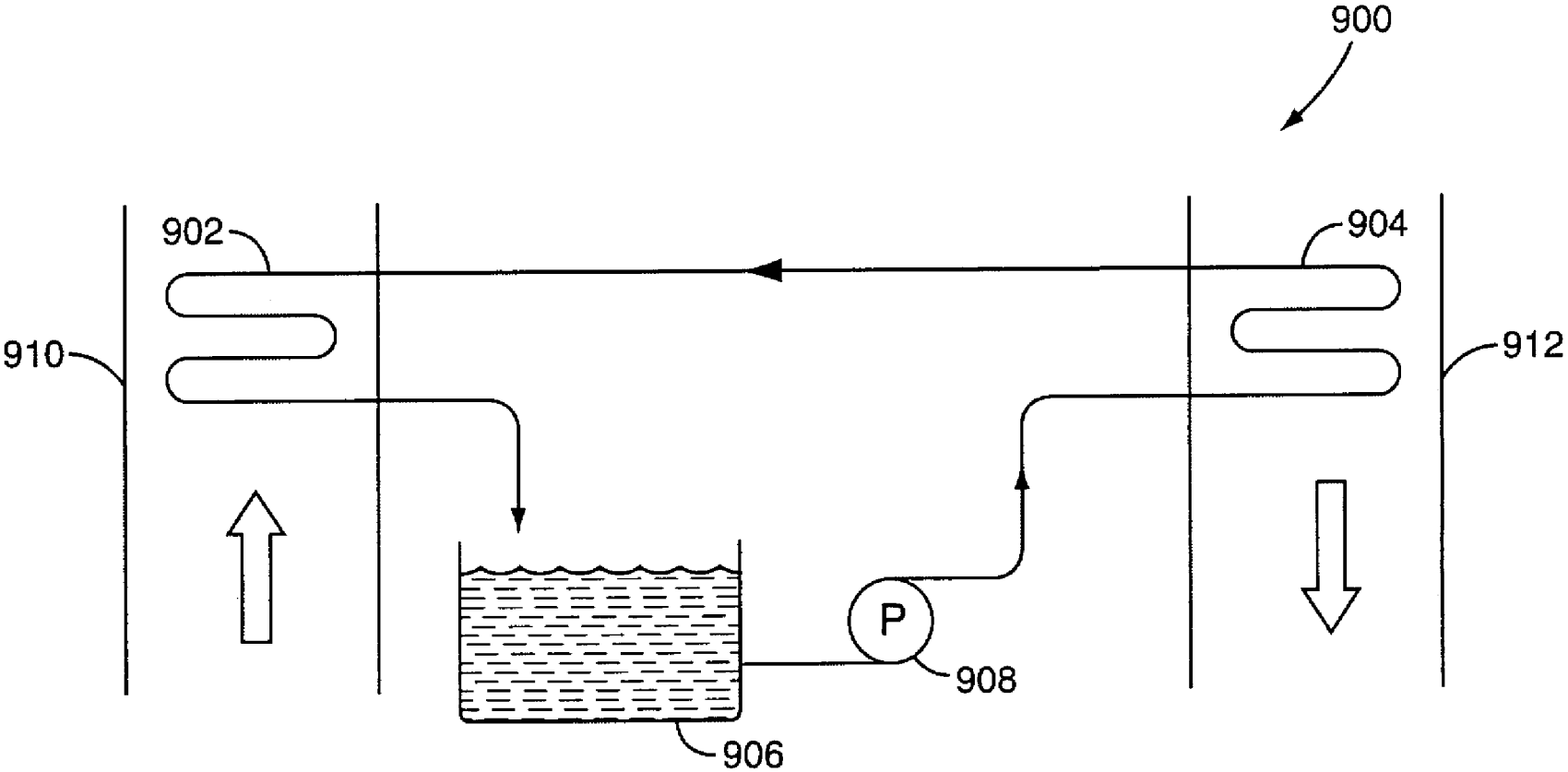
FIG. 12 is a schematic diagram of a heat recovery system using the conditioning apparatus of the present invention.

FIG. 12 illustrates a heat recovery system, indicated generally by the numeral 900, using the conditioning apparatus 10 of the present invention. The heat recovery system 900 is useful in air-conditioning (e.g., heating or cooling) systems where recirculation of air is not desired, such as air-conditioning systems for hospitals, laboratories, clean rooms, and manufacturing facilities. The heat recovery system 900 includes exchange elements 902, 904, recovery tank 906, and pump 908. Exchange element 902 is located within an exhaust duct 910, while membrane coil 904 is located in a fresh air intake 912. The exhaust air passing over membrane coil 902 conditions the brine solution, which enters recovery tank 906. The conditioned brine solution is removed from the recovery tank 906 by pump 908 and passes through exchange element 904 in the air intake 912. The spent brine solution exiting the air intake 912 flows back into the exhaust duct 910 where it is conditioned again by the exhaust air. In a cooling mode, the exhaust air cools and regenerates the brine solution which, in turn, cools and dehumidifies the fresh air in the intake 912. In a heating mode, the exhaust air warms and dilutes the brine solution which, in turn, preheats and humidifies the fresh air in the intake 912.

Figure 13:
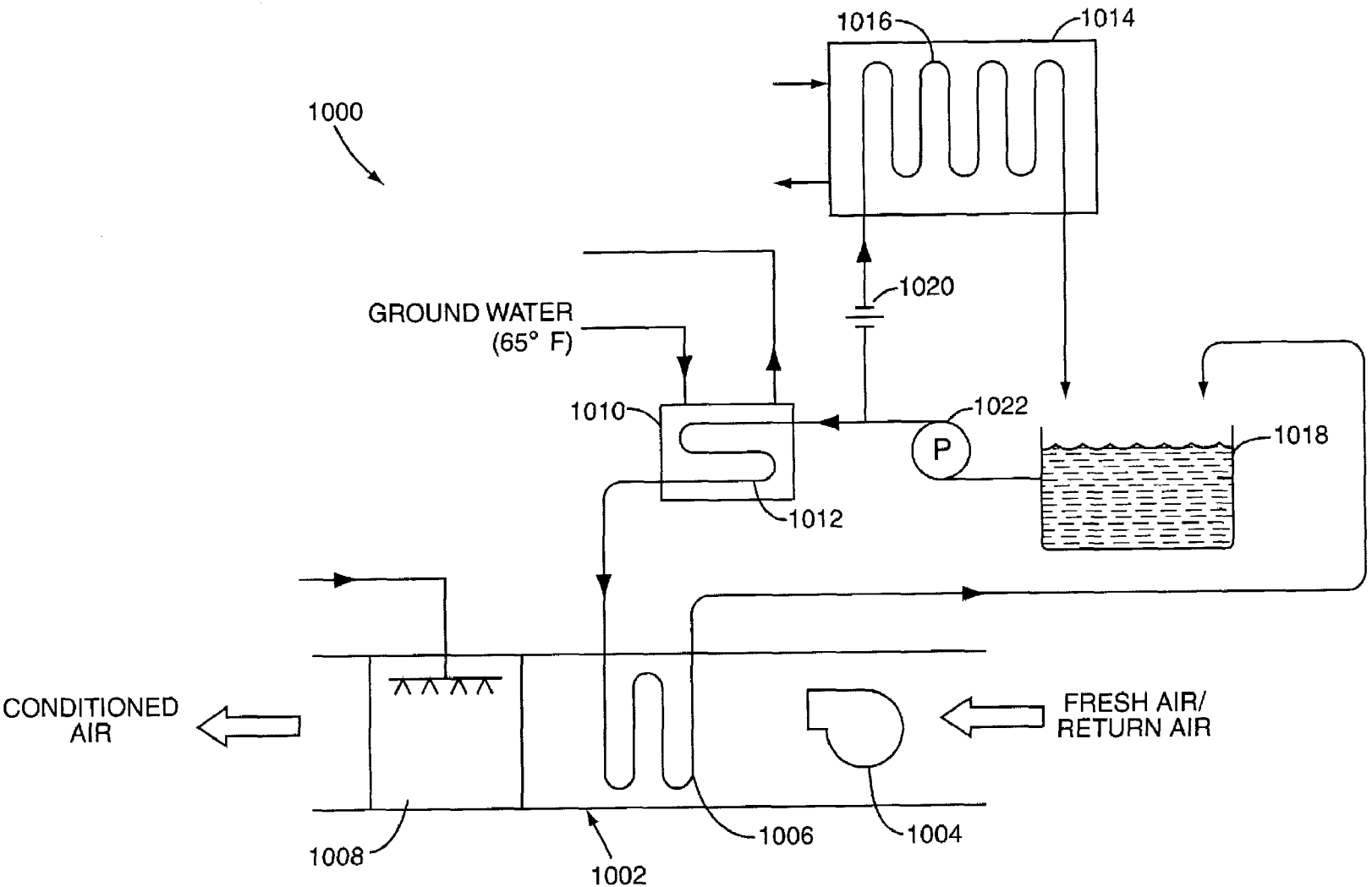
FIG. 13 is a schematic diagram of a solar/geothermal air conditioning system using the conditioning apparatus of the present invention.

FIG. 13 illustrates an air-conditioning system, indicated generally by the numeral 1000, that uses ground water and solar energy for cooling and heating. The air-conditioning system 1000 comprises a heat exchanger 1002, a chiller 1010, solar panel 1014, recovery tank 1018, and pump 1022. Pump 1022 draws brine solution from the recovery tank 1018, which flows through chiller 1010. Chiller 1010 includes a heat exchange tube 1012 through which the brine circulates. Ground water at a temperature of approximately 65° F. cools the brine solution flowing through the heat exchange tubes 1012. The chilled brine solution then enters the heat exchanger 1002. Heat exchanger 1002 includes a blower 1004, an exchange element 1006, and the evaporative cooler 1008. Blower 1004 circulates air over the exchange elements 1006, which are constructed as shown in FIGS. 2 and 3. In a cooling mode, moisture in the air flow is transferred across the semi-permeable membrane of the exchange element 1006 into the brine solution. The brine solution also has a slight cooling effect. The dried air flows through the evaporative cooler 1008, which cools the air to approximately 55° F. Diluted brine solution exiting the heat exchanger 1002 where it mixes with concentrated brine solution flowing out of the solar panel 1014.

Part of the brine solution drawn from the recovery tank 1018 by pump 1022 is diverted into the solar panel 1014. The amount of brine solution flowing to the solar panel 1014 is controlled by orifice 1020. The solar panel 1014 includes exchange elements 1016 constructed as shown in FIGS. 2 and 3. The brine solution is heated by the solar panel 1014 and gives up moisture. The brine solution exiting the solar panel 1014 is a concentrated brine solution. The concentrated brine solution empties into recovery tank 1018 where it mixes with the diluted brine solution from the heat exchanger 1002.

Figure 14:
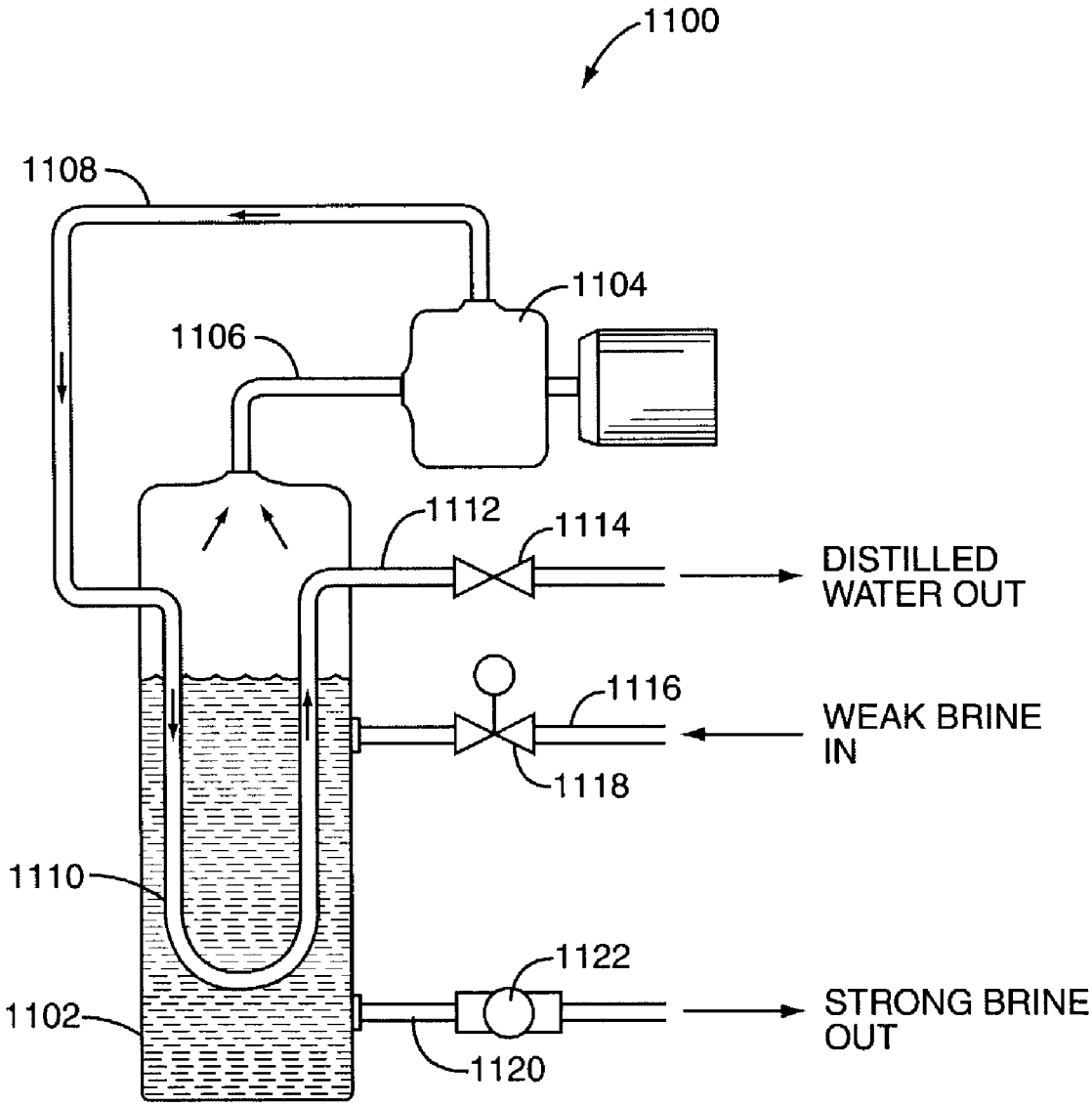
FIG. 14 is a schematic diagram of a distiller used as a regenerator in the conditioning apparatus of the present invention.

FIG. 14 is a schematic diagram of a mechanical distiller indicated generally by the numeral 1100. The distiller 1100 may be used, for example, as a regenerator 24 to concentrate a diluted brine solution. Distiller 1100 includes a distillation chamber 1102 and a compressor 1104. The inlet of the compressor 1104 is connected to the distillation chamber 1102 by line 1106. The outlet of the compressor 1104 is connected by line 1108 to a heat exchange tube 1110 disposed within the distillation chamber 1102. The heat exchange tube 1110 is connected to outlet line 1112 having a pressure regulator 1114. The distillation chamber 1102 itself includes an inlet pipe 1116 and an outlet pipe 1120. Inlet pipe 1116 contains a float valve 1118 that regulates the fluid level in the distillation chamber 1102. Outlet pipe 1120 includes a pump 1122 for removing strong brine solution from the distillation chamber 1102.

In operation, weak saline solution enters the distillation chamber 1102 through inlet pipe 1116. Compressor 1104 draws vapor 5 PSIA to 10 PSIA from the distillation chamber 1102 through line 1106 into the compressor 1104. Compressor 1104 compresses the water vapor to generate a super-heated vapor. The super-heated vapor exits the compressor 1104 along line 1108 and flows through the heat exchange tube 1110 in the distillation chamber 1102. The super-heated vapor flowing through the heat exchange tube 1110 heats and boils the brine solution in the distillation chamber 1102, which produces water vapor. The super-heated vapor in the heat exchange tube 1110 gives up its heat and condenses to distilled water. The distilled water exits through the pressure regulator 1114, which is set to maintain the condensing pressure in the range of 14.7 PSIA to 30 PSIA. Thus, the weak brine solution input along line 1116 gives up water vapor in the distillation chamber 1102 and becomes more concentrated. The concentrated brine solution exits the distillation chamber 1102 along line 1120. A metering pump 1122 controls the amount of brine solution withdrawn from the distillation chamber 1102.

What is claimed is:

1. An apparatus for drying a granular material comprising:

a. a heat exchange element having one or more fluid passages coupled to a source of conditioning solution that flows through said heat exchange element;

b. said heat exchange element including a semi-permeable membrane that allows fluid transfer between said granular material and said conditioning solution, such that the concentration of said conditioning solution changes from a first concentration level to a second concentration level; and c. said heat exchange element disposed within a conditioning chamber, and said granular material flows through said conditioning chamber and passes over said heat exchange element.

2. The apparatus of claim 1 further including a thermal conditioner to thermally condition said conditioning solution in said heat exchange element to effect heat transfer between said granular material and said conditioning solution.

3. The apparatus of claim 2 wherein the thermal conditioner cools said conditioning solution, and wherein the cooled conditioning solution transfers heat from said granular material.

4. The apparatus of claim 2 wherein the thermal conditioner heats the conditioning solution, and wherein the heated conditioning solution rejects heat into said granular material.

5. The apparatus of claim 1 further including a regenerator to concentrate the conditioning solution.

6. The apparatus of claim 1 wherein the conditioning solution is a saline solution.

7. The apparatus of claim 1 further comprising a blower to direct an air flow over said heat exchange element.

8. The apparatus of claim 1 for drying food products.

9. A drying apparatus for drying a granular product comprising;

a. a drying bin;

b. one or more heat exchange elements disposed within said drying bin and coupled to a source of conditioning fluid that flows through said heat exchange elements;

c. said heat exchange elements having a semi-permeable membrane that allows fluid in said granular product to pass through said semi-permeable membrane to said conditioning fluid; and d. a thermal conditioner to cool said conditioning fluid entering into said exchange elements.

10. The drying apparatus of claim 9 further comprising a regenerator to concentrate said conditioning fluid exiting said exchange elements.

11. The drying apparatus of claim 10 wherein said regenerator is coupled to said thermal conditioner.

12. The drying apparatus of claim 9 for drying food products.

13. An apparatus for drying a granular material comprising:

a. a heat exchange element having one or more fluid passages coupled to a source of conditioning solution that flows through said heat exchange element;

b. said heat exchange element including a semi-permeable membrane that allows fluid transfer between said granular material and said conditioning solution, such that the concentration of said conditioning solution changes from a first concentration level to a second concentration level;

c. a thermal conditioner to thermally condition said conditioning solution in said heat exchange element to effect heat transfer between said granular material and said conditioning solution; and d. wherein the thermal conditioner heats the conditioning solution, and wherein the heated conditioning solution rejects heat into said granular material.

14. A clothes dryer comprising:

a. a rotating drum adapted to contain clothing articles to be dried;

b. an air recirculation path in communication with the drum to allow air to enter the drum and to receive air exiting the drum;

c. a blower to circulate air through the air recirculation path to dry the clothing articles in the drum; and d. an exchange element disposed in the air recirculation path to remove moisture from the air exiting the drum, the exchange element having a semi-permeable membrane to allow fluid transfer between the circulating air and a conditioning solution flowing through the exchange element.

15. The clothes dryer of claim 14 wherein the semi-permeable membrane allows fluid transfer such that the concentration of the conditioning solution changes from a first concentration level to a second concentration level.

16. The clothes dryer of claim 14 wherein the exchange element includes one or more fluid passages coupled to a source of the conditioning solution flowing through the exchange element.

17. The clothes dryer of claim 14 wherein the air recirculation path comprises a substantially closed passageway through which the air circulates.

* * * * *